United States Patent [19]

Debarge

[11] Patent Number: 4,653,416

[45] **Date of Patent: * Mar. 31, 1987**

[54] SAILBOARD

[76] Inventor: Philippe Debarge, c/o T.C.F., 2 Quai de la Conférence, 75008 Paris, France

[ * ] Notice: The portion of the term of this patent subsequent to Dec. 17, 2002 has been disclaimed.

[21] Appl. No.: 779,987

[22] Filed: Sep. 24, 1985

Related U.S. Application Data

[63] Continuation-in-part of Ser. No. 577,625, May 18, 1985, Pat. No. 4,558,655.

[51] Int. Cl.[4] ..... B63H 9/06

[52] U.S. Cl. ..... 114/39; 114/93; 114/102; 248/205.9

[58] Field of Search ..... 114/39.2, 102, 103, 114/90, 93; 244/DIG. 1.3, DIG. 1.4; 248/205.8, 205.9

[56] References Cited

U.S. PATENT DOCUMENTS

| | | | |
|---|---|---|---|
| 1,714,422 | 5/1929 | Hanson | 248/205.9 |
| 2,319,727 | 5/1943 | Duggan | 248/205.9 |
| 2,319,999 | 5/1943 | Jennings | 114/102 |
| 3,083,933 | 4/1963 | Cella | 114/253 |
| 3,700,191 | 10/1972 | Page | 244/16 |
| 3,863,868 | 2/1975 | Oberle | 244/16 |
| 3,905,321 | 9/1975 | Blythe, Jr. | 114/103 |
| 4,116,407 | 9/1978 | Murray | 244/DIG. 1.3 |
| 4,382,417 | 5/1983 | Talve | 114/39.2 |
| 4,473,022 | 9/1984 | Eastland | 114/39.2 |
| 4,558,655 | 12/1985 | Debarge | 114/39.2 |

FOREIGN PATENT DOCUMENTS

| | | | |
|---|---|---|---|
| 0070673 | 1/1983 | European Pat. Off. | 114/39.2 |
| 2833616 | 2/1980 | Fed. Rep. of Germany | 114/39.2 |
| 2409189 | 6/1979 | France | 114/39.2 |
| 2457213 | 12/1980 | France | 114/39.2 |
| WO79/01077 | 12/1979 | PCT Int'l Appl. | 114/102 |
| WO82/03053 | 9/1982 | PCT Int'l Appl. | 114/39.2 |

*Primary Examiner*—Trygve M. Blix
*Assistant Examiner*—Edwin L. Swinehart
*Attorney, Agent, or Firm*—Young & Thompson

[57] ABSTRACT

Sailboard comprising a sail assembly and a floatboard (2) supporting the sail assembly. The sail assembly comprises two wings (4, 5) in relatively displaced relation to each other, the two wings having substantially parallel leading edges (6, 7), the two wings being connected together by a rigid supporting frame ensuring a constant relative positioning of the wings. One (7) of those leading edges has an end (7*a*) which is removably and pivotably laid upon the floatboard (2), thus permitting the user to move the sail assembly during navigation between a position where the end (7*a*) of that one leading edge is pivotably laid upon the floatboard and a position where the sail assembly is dissociated from the floatboard and maintained by the user in a substantially horizontal position to produce a sustentation effect.

17 Claims, 13 Drawing Figures

SAILBOARD

This is a CIP of my earlier application Ser. No. 577,625 now U.S. Pat. No. 4,558,655, issued Dec. 17, 1985.

The present invention relates to a sailboard for the purpose of sport which enables the user to perform a wide range of different movements.

Sailboards are already known and are characterized by the association of a floatboard and a substantially triangular sail which the user operates by exerting physical force and which bears on an anchoring point of the board. These devices permit only limited movements.

It is also known to associate a sail of the spinnaker type fitted with a venturi tube and a pair of snow skis, the sail being fastened to the wrists and ankles of the user who is wearing the skis. This association permits only flying ski-jumps which are slowed-down during ski descents.

It is primarily in the field of aquatic sports that interest has focused on the use of wind power for enabling the user to obtain both propulsion or flight effects by air sustentation according to the orientation of a sail with respect to the wind, this sail being orientable in space independently of the support which carries the user. However, in known designs of this type, the sail consisting of a V-wing, for example, is relatively heavy and awkward to handle. Furthermore, its development in width is such that, in practice, it is not capable of occupying all desirable positions and in particular it can neither be inclined at a large angle with respect to the vertical.

An object of this invention is to provide a highly manoeuvrable sailboard which permits rapid changeover from a vertical position of propulsion to a horizontal position of sustentation and conversely without any danger of touching the water.

Another object of this CIP is to reduce the weight of a sailboard according to my earlier application, and to improve the manoeuvrability thereof and the ease in unfolding and then folding the sail assembly prior to use and after use.

In accordance with this CIP, the sailboard comprises a said assembly and a floatboard supporting said sail assembly, said sail assembly comprising two wings in relatively displaced relation to each other, said two wings having substantially parallel leading edges, said two wings being connected together by supporting frame members ensuring at least in use a constant relative positioning of said wings, this supporting frame being provided with gripping means for the user, the leading edges of a first one of the two wings having an end which is removably and pivotably laid on or fixed to the floatboard, thus permitting the user to move the said sail assembly during navigation between a position where said end of said one leading edge of said first wing is pivotably fixed to the floatboard and a position where said sail assembly is dissociated from the floatboard and maintained by the user in a substantially horizontal position to produce a sustentation effect.

A sailboard according to this arrangement has a large total sail area while being of small overall size, thereby enabling the user to handle this sail unit with great ease in the different configurations of use in propulsion and/or in sustentation without any danger of touching the water.

Depending on the choice made by the user, it is possible without exertion of any particular effort either to associate the sail unit with the floatboard in the same manner as a conventional sail attached to a mast which is fixed on a floatboard or to dissociate the sail unit from the floatboard and to orient it in the three dimensions in an endeavor to produce a sustentation effect. This arrangement also permits particularly rapid and reliable tacking, utilization under light wind conditions and more effective means as well as better sailing close to the wind.

Other particular features and advantages of the invention will become more apparent from the following description.

In the accompanying drawings which are given by way of illustrative and non-limitative examples:

Figure 1:
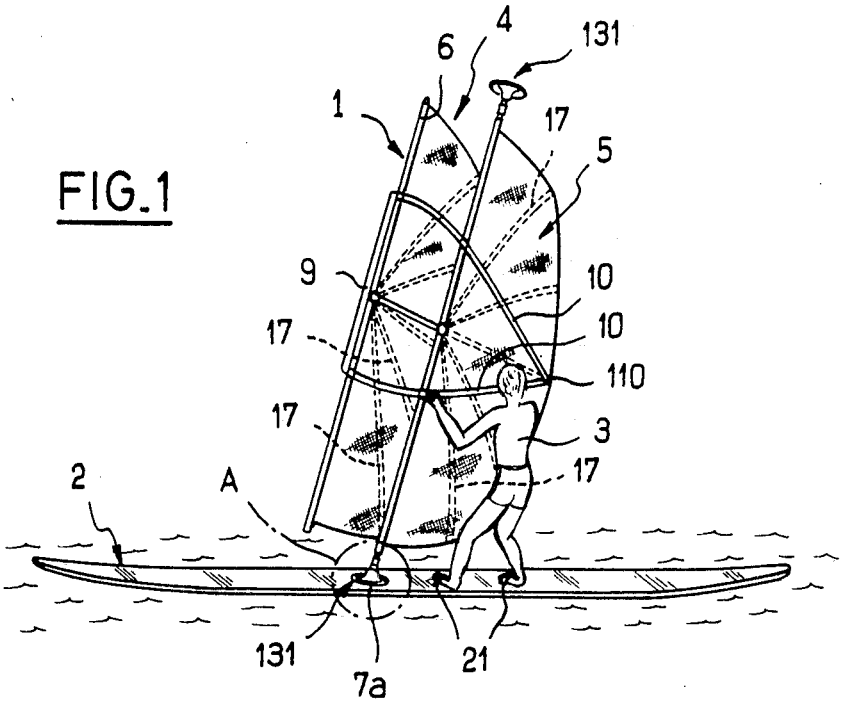
FIG. 1 is a view in elevation of a sailboard having a biplane sail unit in accordance with the invention in a position of use.
Figure 2:
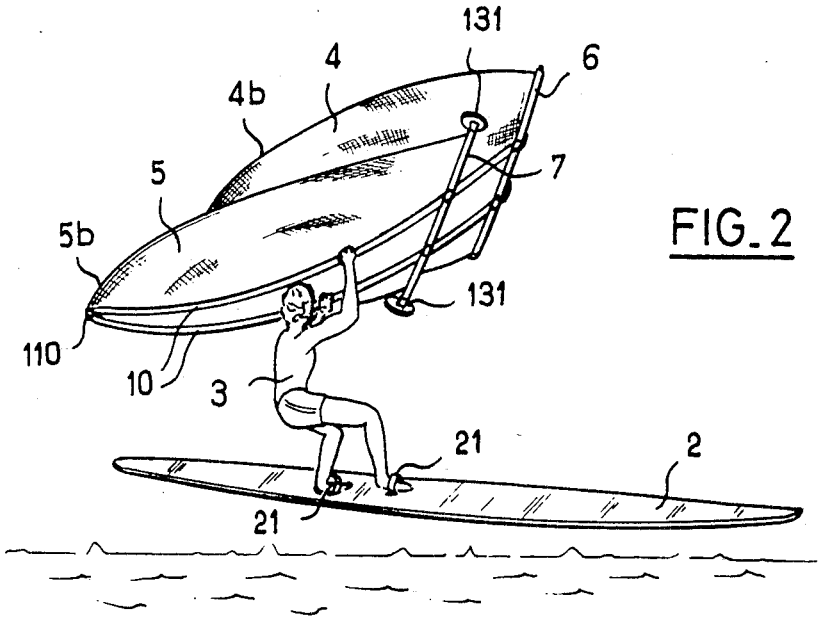
FIG. 2 is a view which is similar to FIG. 1, the sail unit being however dissociated from the floatboard and used with a sustentation effect.

In FIGS. 1 and 2, the sailboard is equipped with a sail unit 1 and a floatboard 2 controlled by a user 3 whose two feet bear on this board and who maintains the sail unit 1 with each hand closed on a respective elongate member 10 forming part of a supporting frame of the sail unit 1.

This sail unit 1 illustrated in detail in FIGS. 3 to 6, comprises two wings 4, 5 made of a sail cloth and having a leading edge 6, 7 and a trailing edge **4*b*, 5*b*. The leading edge 6, 7 comprises a sewn sheath 4*a*, 5*a* in which a edge bar 15, 16 is inserted. The trailing edge 4*b*, 5*b* of each wing 4, 5** has in this example an oval contour.

The plane which joins the mean line of the leading edge 6, 7 and the mid-point of the trailing edge **4*b*, 5*b*** is designated by aerodynamicists as the "wing plane".

Figure 4:
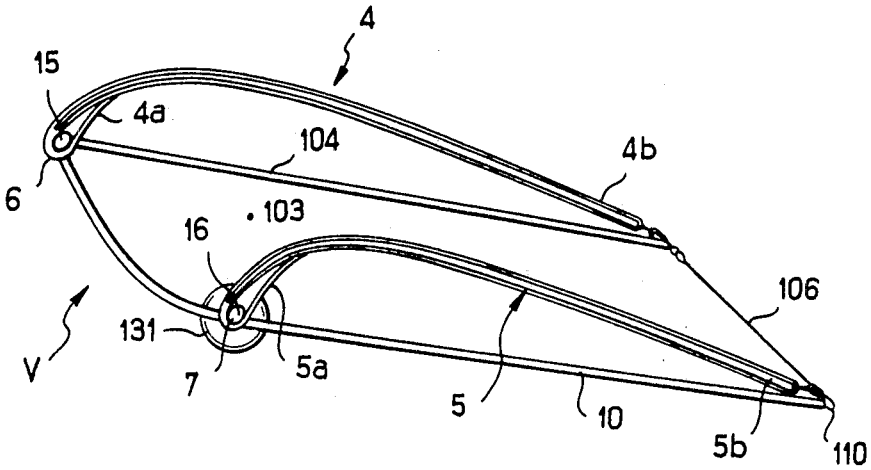
FIG. 4 is a cross sectional view of the sail unit along the plane IV—IV of FIG. 3.

In the embodiment illustrated in FIG. 4, the wing planes 4, 5 are substantially parallel.

Each wing is substantially symmetrical with respect to a plane at right angles to the plane of the wing, the line common to these two planes being designated as the "wing axis". Said plane at right angles is the same for the two wings.

The wing 5 will be designated as first wing or the "windward wing" and the other wing 4 will be designated as the "leeward wing" or the second wing. The leeward wing 4 is displaced with respect to the windward wing 5 in the direction of its axis and in the direction which extends from the trailing edge **4*b* to the leading edge 6**.

This mutual positioning of the wings is performed by frame members which will be described hereinafter.

Each edge-bar 15, 16 is essentially made of two elements or half edge-bars which are articulated to eachother in 101 and 102 respectively, substantially at mid-length of the edge-bars.

Moreover, each wing 4, 5 comprises stiffening slats 17 which are held in elongated pockets provided on the sailcloth so as to diverge from the articulation 101 or 102 towards the trailing edge **4*b* or 5*b***.

Figure 5:
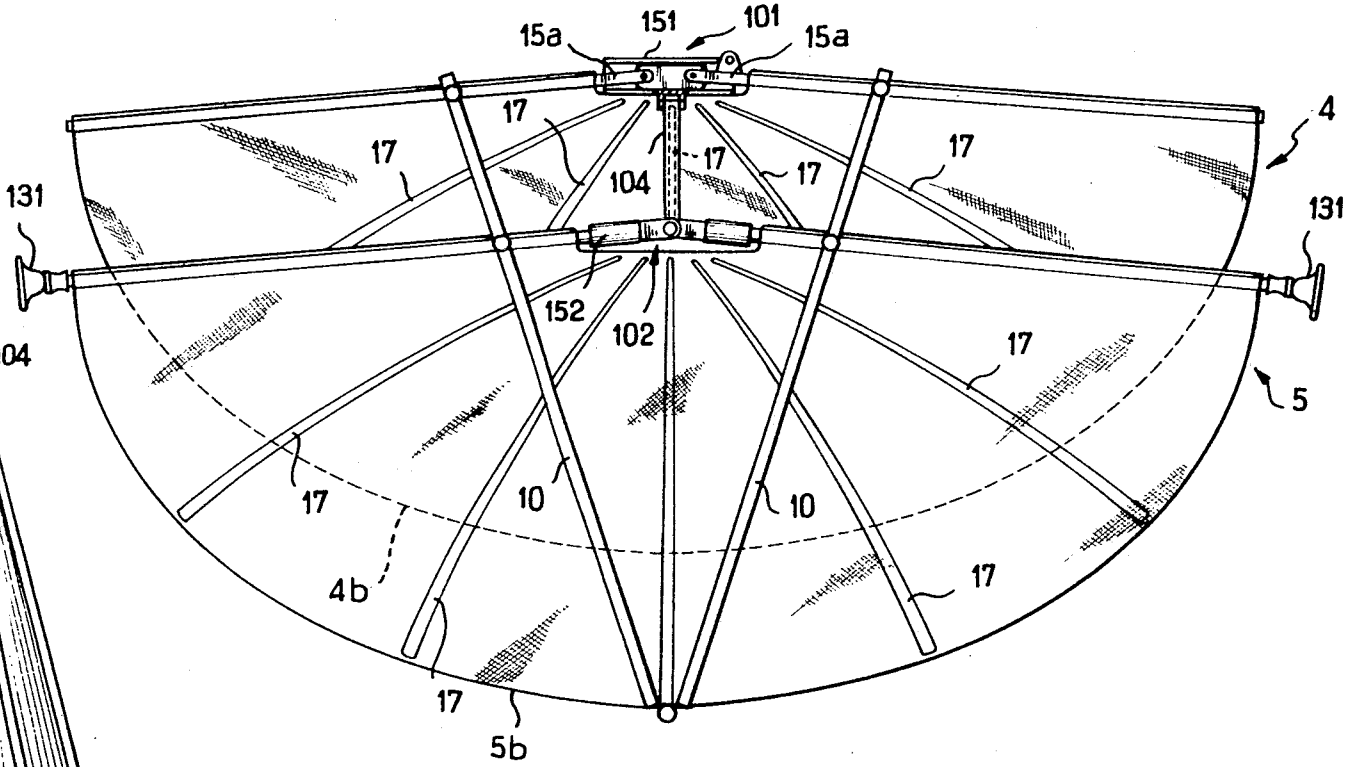
FIG. 5 is a plan view of the sail unit in the fanned out position.
Figure 6:
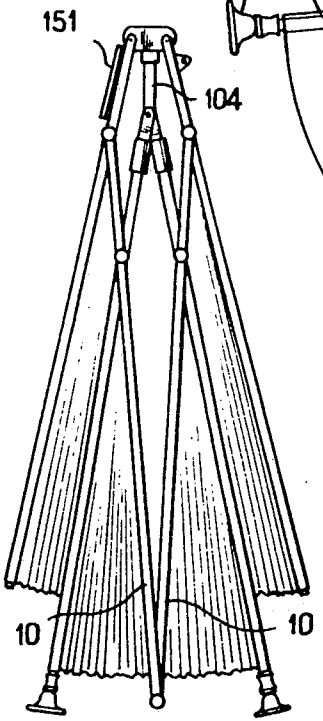
FIG. 6 shows the sail unit in the folded position.

It will be apparent that operation of the articulations 101 and 102 allows the wings and especially the sailcloth and the slats 17 thereof to fan out, from a folded position shown in FIG. 6 to an unfolded position shown in FIG. 5, and conversely.

The two elongate frame members 10 extend along wing 5 outside a space 103 (FIG. 4) between the wings and extend beyond the leading edge 7 of wing 5 so as to reach the leading edge 6 of wing 4. Each elongate member 10 is incurvated towards the wings and is articulated to both edge bars 15 and 16. The elongate members 10 are also articulated together in 110 adjacent the trailing edge **5*b* of wing 5. The mid-point of the trailing edge 5*b* is releasably connected to articulation 160. From this articulation, the elongate members 10 diverge from each other, and the articulations 101, 102 of the edge bars are at mid way between the members 10**.

It will be appreciated that the elongate members 10 constitute a foldable frame and perform a mechanical coupling of the wings so that they fan out or on the contrary fold simultaneously when the elongate members are moved away from each other or towards eachother. The connection between the trailing edge **5*b* and the articulation 110 is released prior to the folding operation, so as to allow the latter to increase the distance between articulation 102 and the position 110 where members 10 are connected together. In the fanned out position, the articulations are locked by means such as a pivoting rod 151 acting as a belt (shown in the active position) or, on articulation 102, a movable sleeve 152** (shown in the released position).

As better seen in FIG. 5, articulation 101 of the edge bar 15 in wing 4 is of a double type, both half edge-bars **15*a* being connected together through a central block carrying a yoke to which a longitudinal stretcher bar 104 is articulated. The other or free end of bar 104 is connected to a mid-point of the trailing edge 4*b* of wing 4. There is a flexible connecting means 106 (FIG. 4) between the free end of bar 104 and the articulation 110. The length of the connecting means 106 is such that the wings 4 and 5 will have their above depicted relative position wing when the connecting means 106 is stretched. This stretching occurs in use by the effects of the wind passing through space 103. The bar 104, and the sailcloth of the wing 4 pivot around the edge bar 15 to take their position as determined by the connecting means 106**, which may be adjustable in length.

Figure 7:
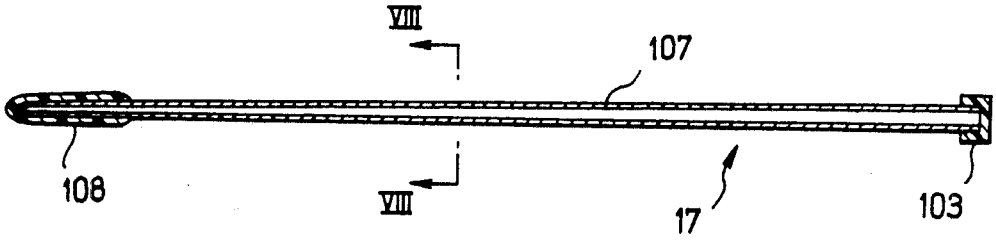
FIG. 7 is a sectional view of a stiffening-slat used in the wings of the sail unit.
Figure 8:
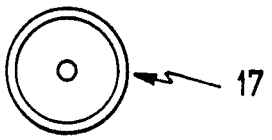
FIG. 8 is a cross sectional view of the slat along the plane VIII—VIII of FIG. 7.

As shown in FIG. 4, it is desirable that the wings 4 and 5 be given by the wind a so-called plane-wing profile. This is obtained by means of a special construction of the slats 17 which is shown in FIGS 7 and 8. Each slat comprises a tapered tube 107, which is substantially conical, internally as well as externally. This tube 107, made of a glass fiber and resin material, carries two end plugs 108, 109 of plastic or rubber which are intended to avoid that the tube damage the sail cloth, and, if the tube is not closed itself, to seal the tube at both ends, so that the tube, full or air, have a position buoyancy, for safety purposes. These slats are inserted in the pockets of the wings so as to taper towards the leading edges of the wings, and thus to be more yieldable adjacent or near the leading edges of the wings.

In FIG. 1, it can also be seen that one end **7*a* of the leading edge 7 of the wing 5 is mechanically and releasably associated with the floatboard 2 for fastening and adjustably positioning the end 7*a* of the leading edge 7 on the floatboard 2**.

Figure 9:
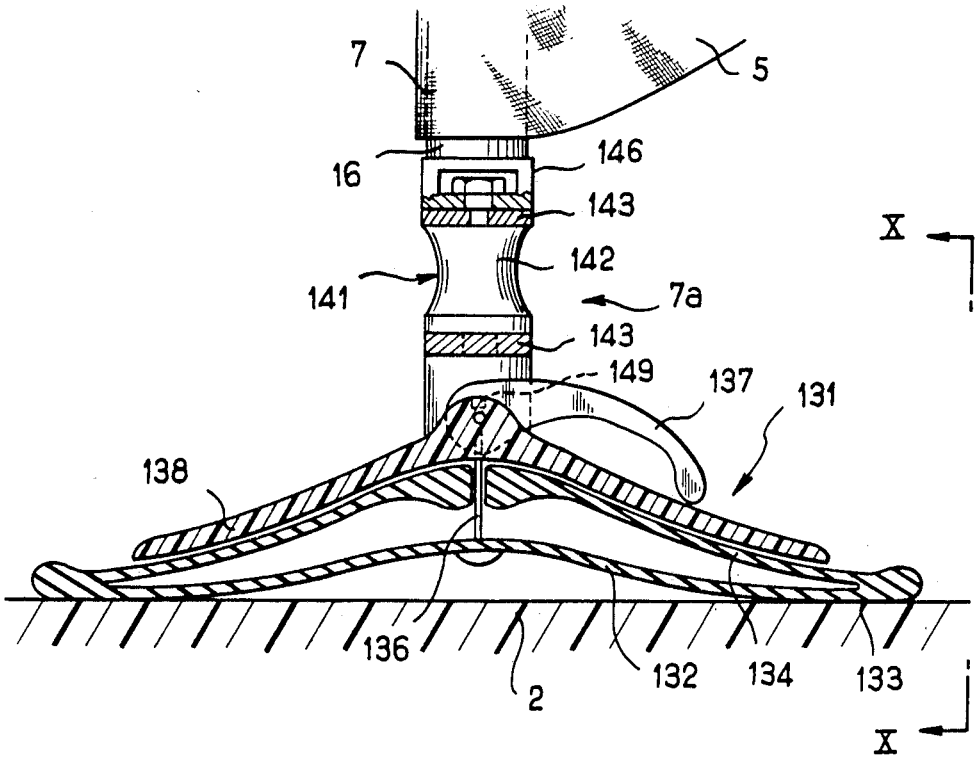
FIG. 9 is a part sectional view, at an enlarged scale, of the detail A of FIG. 1.

As shown in FIG. 9, the releasable fastening means 131 comprises a suction-cup which is secured by its center part at the end of the edge bar 16 and comprises a suction membrane 132 connected by its free edge 133 to an upper skirt 134 and by its center to a control rod 136 passing through the skirt 134 and pivoted to an eccentrated position 139 of a handle 137 which is pivoted to a rigid cover 138 overlapping the skirt 134. When the handle is in its lower position, the suction membrane 132 is in its suction, concave position, which performs adherance between the end **7*a* and the floatboard 2. The respective positions of the pivotal axis of the handle 137 and of the connection between the handle and the control rod 136** perform a self-locking in the suction position of the membrane.

Suction cups of the type just described are in use among glaziers to carry the glass pieces, and are sometimes called "glazier's suction cups".

The connection between the edge bar 16 proper and the suction cup 131 occurs through a silent-block like element 141, of a type which is available in the commerce and comprises a rubber section 142 between two end plates 143. One of these plates is secured to a yoke 144 provided on cover 138 for journalling the handles 137. The other plate 143 is secured to a connector 146 allowing the edge bar 16 to pivot about its own axis with respect to the silent-block-like element 141.

It will be apparent that this embodiment of the end **7*a* of leading edge 7 allows positioning said end at any desired position on the surface of the floatboard and then inclining at will the sail unit while bending the silent-block-like element without disturbing adherence of the suction cup on the floatboard, and then or at the same time rotating the sail unit with respect to the floatboard by means of the connector 146 for releasing the adherence of the suction cup against the floatboard, the user lifts handle 137 with his or her foot thus allowing the distance between membrane 132 and board 2** to diminish.

Figure 3:
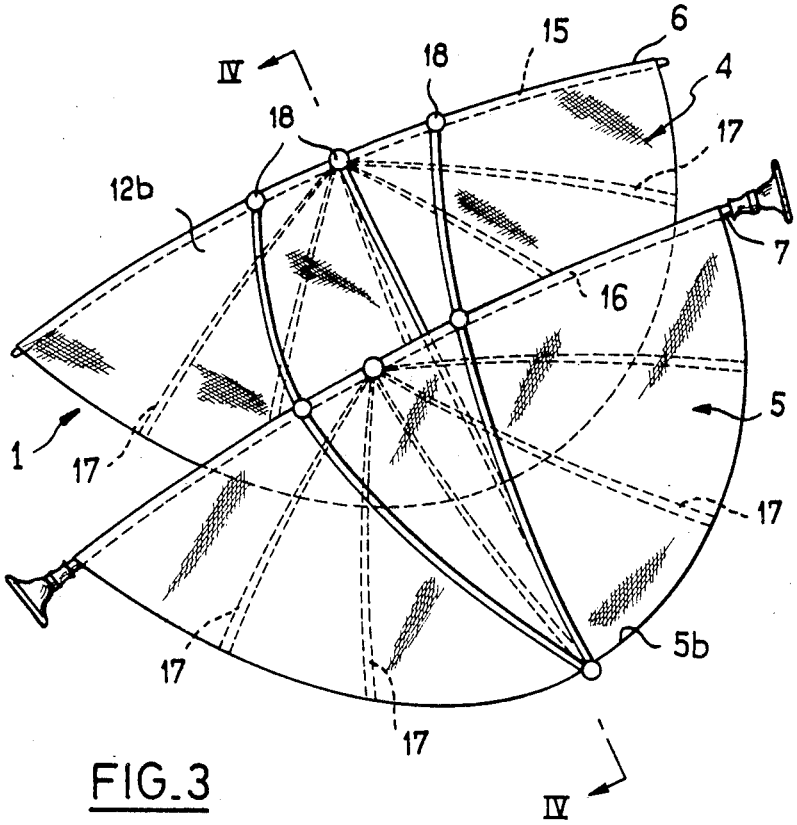
FIG. 3 is a perspective view of the sail unit of FIGS. 1 and 2.

As shown in FIG. 1 or 3 for example, a similar device with a suction cup, a block-like-element and a pivotal connector is provided at the other end of the leading edge 7. Thus, the user, having for example used the sail unit in an horizontal position for jumping or flying as shown in FIG. 2, can then come back to a sailing position by adhering one or the other end of the leading edge 7 to the floatboard.

Figure 10:
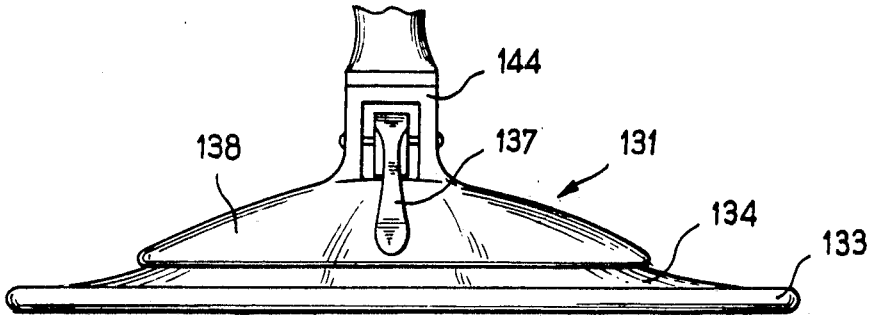
FIG. 10 is a view along X—X of FIG. 9.

In use for flying, the suction cups constitute airguides helping air to enter the space 103 instead of escaping laterally. With a purpose of better aerodynamic properties, the edge 133 (FIGS. 9 and 10) of the suction cups are rounded. The thus relatively thick edge 133 also allows the user to release the suction directly with his or her foot hitting the edge 133.

Figure 11:
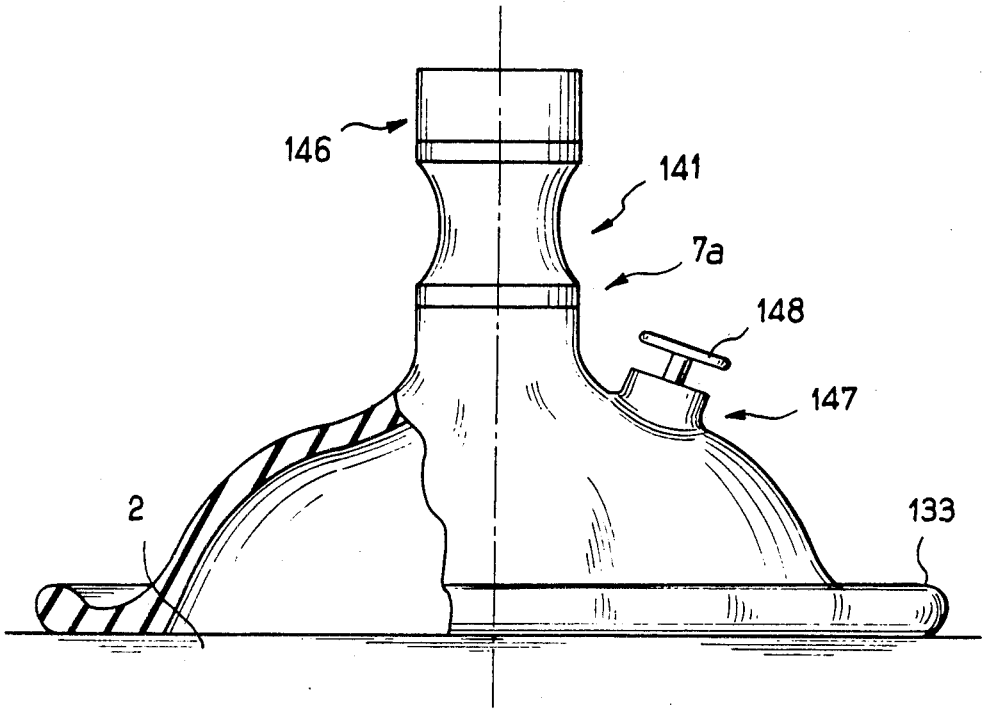
FIG. 11 is a view similar to FIG. 10 but concerning another embodiment.

In the embodiment of FIG. 11, the glazier's suction cup is replaced by a suction-cup having a check-valve 147 which allows escape of air when the suction-cup is adhered against the floatboard 2, but prevents subsequent entry of air, so as to retain the adhered condition. The check-valve 147 is provided with a release knob 148 that the user actuates with his or her foot so as to allow entry of air in the suction cup through the check-valve.

Figure 12:
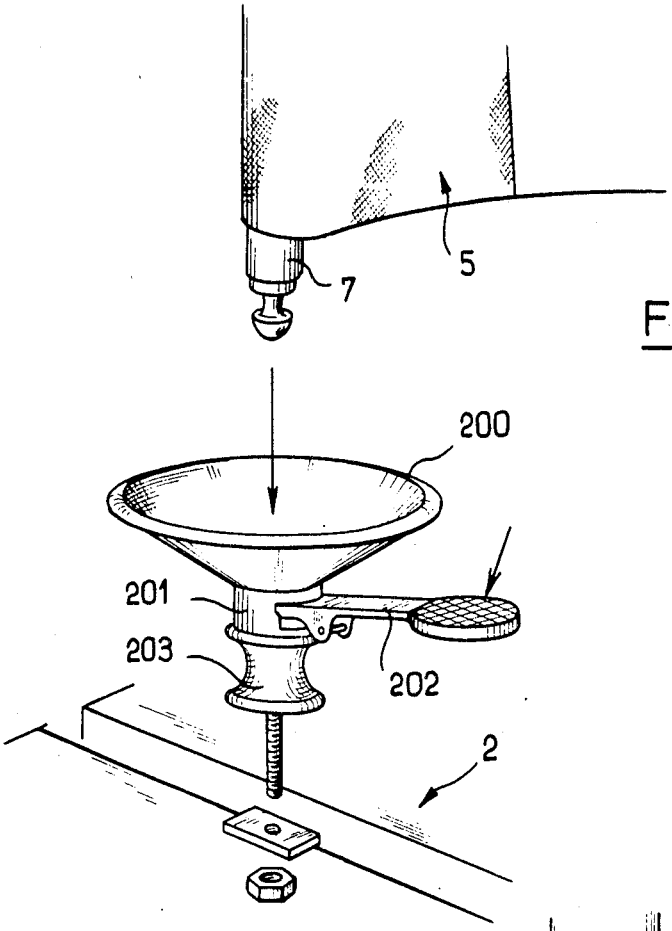
FIG. 12 is a perspective and exploded view concerning an alternative embodiment of means for removably fixing the leading edge.

In the embodiment of FIG. 12, the means for removably fixing the leading edge of one of the wings comprise a cup 200 open toward the leading edge and having at its bottom a hollow part 201 adapted to receive the end of the leading edge. Said leading edge is conformed so as to be automatically locked, when it is engaged into the hollow part 201 by the means of a not shown locking device. Such locking device cooperates with a lever 202 which can be actuated by the user's foot and which permits to unlock the end of the leading edge with respect to the hollow part 201.

Figure 13:
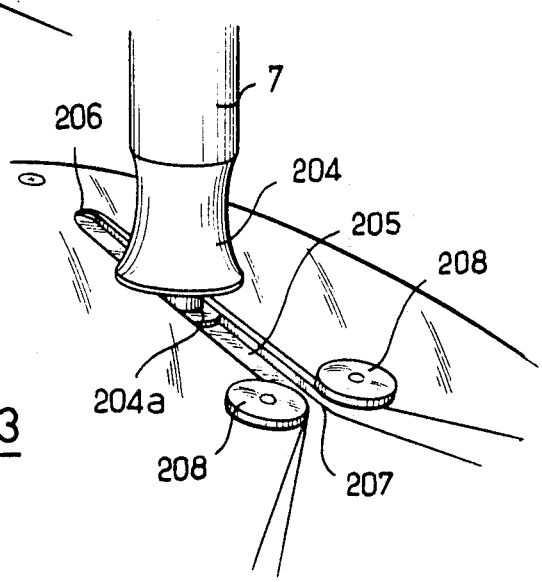
FIG. 13 is a perspective view of an another embodiment of means for removably fixing the leading edge.

The cup 200 is fixed on the sailboard 2 by the means of a silent-block-element 203. In the embodiment of FIG. 13, the end of the leading edge is provided with a silent-block-element 204 having at its end a locking device 204*a* which is engaged in a recess 205 provided in the sailboard. The recess 205 has a closed end 206 and an open end 207. At the open end 207 of the recess 205 are provided two flat rollers 208 defining between each other a gap narrower than the distance between the two edges of the recess 205. The two flat rollers 208 are made from a resilient material. These two flat resilient rollers 208 prevent the locking device 204*a* from escaping laterally unvoluntarily from the recess 205. When the user desires to remove the end of the leading edge 7 from the recess 205, he must push against said leading edge 7 with a sufficient force to overcome the resistance opposed by the resilient flat rollers 208.

The pilot 3 may, although he is not obliged to do so, engage his feet within pockets 21 made integral with the board 2 and formed of flexible material of known type constituted by wide bands of plastic material.

This is the case when the pilot 3 uses a so-called "jumping" board 2 which, apart from its small dimensions and low weight, is provided with pockets 21 of this type for the feet. However, the pilot 3 may employ any type of boards such as the so-called "speed" boards or "regatta" boards which are thin and tapered but not provided with pockets 21 of this type, or even boards for gliding along the flanks of waves and known as surf-boards.

The operation of the sail unit described is as follows:

Since each wing 4, 5 (see FIG. 4) which receives the wind coming from the direction represented by way of example by the arrow V is maintained by an edge bar 6 or 7 and at a central point of its trailing edge 4*b* or 5*b*, the wing produces a force which, in a first approximation, is perpendicular to the plane of the wing comprising the leading edge 6, 7 and the central point of the trailing edge 4*b*, 5*b*.

In the utilization shown in FIG. 1 in which the end of the leading edge 7 is associated with the board 2, the sail unit operates in normal propulsion as a conventional sailboard.

However, since the sail unit of the sailboard in accordance with the invention is constituted by two wings 4, 5 having an equal total sail area, the transverse dimensions are smaller.

The manoeuvrability of this sail unit is considerably improved as a result. In particular, tacking movements are performed very rapidly by lifting the sail unit 1 above the user's head, by turning the board 2 with the feet, then by adhering the other end of the leading edge 7 to the floatboard. This operation is distinctly easier and faster than with conventional sailboards on which the pilot must necessarily advance towards the front end of the board, pass around the mast and then take a few steps toward the rear while gripping the other element of the wishbone.

Taking into account the small overall size of the sail unit 1, the user can set this latter in the vertical position without difficulty in order to obtain maximum traction.

Furthermore, the invention makes it possible to use the sail unit 1 without connecting it to the floatboard 2, as shown in FIG. 2. The pilot has the possibility of three-dimensional orientation of the sail unit 1 and in particular by judiciously placing this latter substantially in a horizontal position in order to produce a force whose vertical component or sustentation force becomes of optimum value. In particular, this sustentation force can substantially balance the weight of the sail unit 1. By judiciously utilizing the sustentation force, the sail unit has a very low apparent weight, with the result that the user exerts a low effort in order to maintain this latter.

In addition, when the wind is sufficient, this sustentation force can attain high values and enable the pilot to perform a prolonged jump while "planing" for several seconds, during which time the pilot is suspended from the sail unit 1 whose leading edges 6, 7 are substantially horizontal and maintains the board 2 lifted above the water by means of his feet engaged within the pockets 21 (see FIG. 2).

The use of the sail unit 1 independently of the moving support constituted by the board 2 under all wind conditions is possible or optimized only by virtue of the multiplane concept of this latter. In fact, a conventional triangular monoplane sail has either small dimensions and therefore an insufficient useful surface area or conventional dimensions which permit normal propulsion of the board but, in this case, its dimensions are such that the lower end of the sail will almost inevitably come into contact with the surface of the water when it is inclined at an angle close to the vertical.

The improvements according to the CIP yet reduce the weight and increase the manoeuvrability of the sailboard according to the invention. Especially, the releasable securing means comprising a sucking cup at the ends of the leading edge 7 suppress the need of any complementary device in the floatboard, except perhaps a convenient coating for avoiding that the sucking cup slide on the wet board. However, the sucking cup is easier to use because the user does not need to select the position where he will adhere the sucking cup.

The slots according to the invention have a very low weight with respect to their stiffness.

The frame arrangement, essentially made of two arcuate elongate members is also less heavy than the arrangement in my initial application. The longitudinal rod 13*a* can even be dispensed with, and replaced by a somewhat reinforced central slat in the wing 4.

Moreover, my new foldable structure allows fanning out the sail unit from the storage condition to the sailing condition within around 1 minute.

I claim:

1. Sailboard comprising a sail assembly and a floatboard (2) supporting said sail assembly, said sail assembly comprising two wings (4, 5) in relatively displaced relation to each other, said two wings having substantially parallel leading edges (6, 7), said two wings being connected together by supporting frame ensuring at least in use a constant relative positioning of said wings, this supporting frame being provided with gripping means (8, 10) for the user, the leading edge (7) of a first one (5) of the wings having an end (7*a*) which is removably and pivotably laid upon the floatboard (2), thus permitting the user to move the said sail assembly during navigation between a position where said end (7*a*) of said leading edge of said first wing is pivotably laid on the floatboard and a position where said sail assembly is dissociated from the floatboard and maintained by the user in a substantially horizontal position to produce a sustentation effect.

2. A sailboard according to claim 1, wherein a second one (4) of the wings is pivoted with respect to the frame adjacent the leading edge of said second wing and wherein trailing edges (4*b*, 5*b*) of the wings are connected together by a flexible connecting means.

3. A sailboard according to claim 2, comprising a stretcher rod which is pivoted with respect to the frame and connects the leading edge (6) and the trailing edge (4*b*) of the second wing (4).

4. A sailboard according to claim 1, wherein the frame comprises two incurvated members (10) extending along the first wing (5) outside a space (103) between the wings (4, 5), each said incurvated member (10) connecting a trailing edge (5*b*) of the first wing (5) to the leading edge (7) thereof and to the leading edge (6) of the second wing (4), said two incurvated members (10) being spaced apart from each other adjacent each said leading edge (6, 7).

5. A sailboard according to claim 4, wherein the elongate members (10) are connected to each other adjacent the trailing edge (5*b*) of the first wing (5).

6. A sailboard according to claim 5, wherein each leading edge (6, 7) comprises two edge bars (15, 16) articulated together between the incurvated members (10), and the incurvated members (10) are articulated to eachother adjacent said trailing edge (5*b*) of the first wing (5).

7. A sailboard according to claim 1 wherein each wing (4, 5) comprises adjacent its leading edge (6, 7) two half edge bars (15*a*) articulated to each other so as to be able to fan out from a folded position to a service position, and wherein the frame is of a foldable type and couples the half edge bars (15*a*) of the two wings (4, 5) for simultaneous faning out movement of both wings (4, 5) and unfolding of the frame.

8. A sailboard according to claim 7, wherein each wing (4, 5) comprises slats (17) which diverge from adjacent a position where the half edge bars (15*a*) are articulated together.

9. A sailboard according to claim 1 wherein each wing (4, 5) comprises slats (17), each slat (17) comprising a tube (107) tapering from a trailing edge (4*b*, 5*b*) to the leading edge (6, 7) of the wing (4, 5).

10. A sailboard according to claim 9, wherein each tube (107) is closed at both ends and has a positive buoyancy.

11. A sailboard according to claim 1, wherein said end (7*a*) of the leading edge (7) of the first wing (5) is provided with a suction cup (131) adpated to be removably applied against the floatboard (2) for removably fixing the sail assembly to the floatboard (2).

12. A sailboard according to claim 10, wherein said suction cup (131) is provided with an annular edge (133) having a rounded profile.

13. A sailboard according to claim 11, wherein said end (7*a*) of the leading edge (7) of the first wing (5) is connected to the suction cup through a resilient bendable element (141).

14. A sailboard according to claim 13, wherein the bendable element is a silent-block-like element (141).

15. A sailboard according to claim 13, wherein the suction cup (131) is provided with releasing means (136, 137, 139, 148, 133).

16. A sailboard according to claim 15, wherein the relasing means comprises means (136, 137) for controlling a distance between a suction membrane (132) of the suction cup (131) and the floatboard (21).

17. A sailboard according to claim 15, wherein the releasing means comprises means (148) for releasing a check-valve (147) of the suction cup (131).

* * * * *